US006837521B2

(12) United States Patent
Legrand

(10) Patent No.: US 6,837,521 B2
(45) Date of Patent: Jan. 4, 2005

(54) FOAM BOOK WITH IMPROVED BINDING AND METHOD

(76) Inventor: Christian Nol Guy Legrand, 100/203 Mooban Chollada, District Ban Bua Thong, Nonthaburi Province 11110 (TH)

( * ) Notice: Subject to any disclaimer, the term of this patent is extended or adjusted under 35 U.S.C. 154(b) by 0 days.

(21) Appl. No.: 10/094,764

(22) Filed: Mar. 11, 2002

(65) Prior Publication Data

US 2002/0167159 A1 Nov. 14, 2002

(30) Foreign Application Priority Data

Apr. 23, 2001 (TH) ..... 0103000152

(51) Int. Cl.[7] ..... B42D 1/00; B42D 5/00

(52) U.S. Cl. ..... 281/21.1; 281/15.1; 281/51; 402/8; 402/9; 402/13; 402/57; 434/309; 434/317; 434/159; 412/6; 412/33; 412/36; 446/147; 446/155; 283/115; 40/530; 40/726

(58) Field of Search ..... 281/15.1, 21.1, 281/51; 402/8, 57, 9, 13; 446/147, 155; 434/159, 309, 317; 412/6, 33, 36; 283/115; 40/530, 726

(56) References Cited

U.S. PATENT DOCUMENTS

| | | | | | |
|---|---|---|---|---|---|
| 906,365 | A | * | 12/1908 | Baker | 402/13 |
| 1,013,125 | A | * | 1/1912 | Campbell | 402/13 |
| 1,322,344 | A | * | 11/1919 | Reschke | 402/9 |
| 1,479,607 | A | * | 1/1924 | Inman | 402/9 |
| 2,098,814 | A | * | 11/1937 | Swanson | 206/39 |
| 3,467,479 | A | * | 9/1969 | Holes et al. | 402/13 |
| 4,149,738 | A | * | 4/1979 | Illos et al. | 283/72 |
| 4,280,241 | A | * | 7/1981 | Pfaff | 412/3 |
| 4,427,390 | A | * | 1/1984 | Manger | 434/159 |
| 4,775,257 | A | * | 10/1988 | Rigg | 402/9 |
| 4,828,289 | A | * | 5/1989 | Korner | 281/15.1 |
| 4,978,141 | A | * | 12/1990 | Wu | 281/15.1 |
| 5,213,507 | A | * | 5/1993 | Ozrovitz | 434/178 |
| 5,464,253 | A | * | 11/1995 | Farrell | 281/38 |
| 5,620,206 | A | * | 4/1997 | Flores | 281/21.1 |
| 5,848,851 | A | * | 12/1998 | Gunasekera | 402/79 |
| 5,962,087 | A | * | 10/1999 | Ruschak et al. | 428/16 |
| 6,070,909 | A | * | 6/2000 | Kaufman | 281/37 |
| 6,189,932 | B1 | * | 2/2001 | Kaufman | 281/37 |
| 6,234,534 | B1 | * | 5/2001 | Warren | 281/37 |
| 6,336,665 | B1 | * | 1/2002 | Kaufman | 281/37 |
| 6,364,360 | B1 | * | 4/2002 | Kaufman | 281/15.1 |
| 6,390,507 | B1 | * | 5/2002 | Derraugh et al. | 281/15.1 |
| 2002/0006763 | A1 | * | 1/2002 | Forbes et al. | 446/1 |
| 2003/0094806 | A1 | * | 5/2003 | Derraugh | 281/21.1 |

FOREIGN PATENT DOCUMENTS

| | | | | |
|---|---|---|---|---|
| FR | 2823697 | A3 | * 10/2002 | B42D/1/06 |

* cited by examiner

*Primary Examiner*—Andrea Wellington
*Assistant Examiner*—Mark Henderson
(74) *Attorney, Agent, or Firm*—Adam H. Jacobs

(57) ABSTRACT

A book with improved binding includes a front cover page having at least one binding hole extending therethrough, a rear cover page having at least one binding hole extending therethrough and at least one center page having at least one binding hole extending therethrough which is positioned between the front and rear cover pages. Each of the front, rear and center pages are constructed of foam material and the invention includes at least one binding cord which extends through each of the binding holes of the front cover page, rear cover page and center pages for binding the pages to one another in book format.

2 Claims, 3 Drawing Sheets

FOAM BOOK WITH IMPROVED BINDING AND METHOD

CROSS-REFERENCE TO RELATED FOREIGN PATENT

This application claims priority based on a foreign patent, specifically on the Thailand Petty Patent Serial No. 0103000152 filed Apr. 23, 2001 and issued to Christian No ël Guy Legrand, the above-named inventor, on Dec. 28, 2001.

BACKGROUND OF THE INVENTION

1. Technical Field

The present invention relates to children's books and, more particularly, to a book which includes a front cover page having at least one binding hole extending therethrough, a rear cover page and at least one center page positioned between the front and rear cover pages each of which also include at least one binding hole, the pages constructed of a foam material, and at least one binding cord which extends through each of the binding holes of the front and rear cover pages and at least one center page for binding the pages in a book format.

2. Description of the Prior Art

There are many different kinds of books and bookbindings which are currently used in the publishing industry. While the majority books are constructed of paper and paper products, there are many types of children's books which are constructed of different materials such as cloth, foam or the like, in order to provide additional tactile sensations for the children reading the books. Currently, it is becoming popular to manufacture children's books from thin plates of foam which constitute the pages and front and rear covers. These are bound in various types of ways such as by gluing the pages to one another, stapling the pages or binding them with a loom as is done with paper-paged books. Each of these binding methods includes inherent defects, however, such as that books bound with staples will become rusty and eroded when exposed to water, those bound with a loom will wear out due to the construction method and materials and books bound with glue tend to not last very long when used by children due to the intensity of the use to which they are subjected. There is therefore a need for an improved book construction for children's foam books which will overcome many of the deficiencies found in the prior art.

It is therefore a object of the present invention to provide a foam book having an improved binding.

Another object of the present invention is to provide a book which includes front, rear and center pages each including at least one binding hole and a binding cord extending through the binding holes for securing the pages to one another.

Another object of the present invention is to provide a foam book with an improved binding which will substantially increase the durability and longevity of the book.

Another object of the present invention is to provide a foam book having an improved binding in which the binding cord is looped through the binding holes of each page a number of times to increase the binding strength and enhance the durability and appearance of the children's book.

Finally, an object of the present invention is to provide an improved foam book with an improved binding which is relatively simple to manufacture and is safe and durable in use.

SUMMARY OF THE INVENTION

The present invention provides a book which includes a front cover page having at least one binding hole extending therethrough, a rear cover page having at least one binding hole extending therethrough and at least one center page having at least one binding hole extending therethrough which is positioned between the front and rear cover pages. Each of the front, rear and center pages are constructed of foam material and the invention includes at least one binding cord which extends through each of the binding holes of the front cover page, rear cover page and center pages for binding the pages to one another in book format.

The improvements of the present invention over the prior art are easily seen and include the fact that the use of a binding cord to secure the pages to one another eliminates the possibility of toxic glue substances being used to bind the pages which could be accidentally ingested by a young individual using the book. Furthermore, the elimination of staples as a binding agent eliminates the possibility of injury due to contact with the staples, as the binding cord which is used in the present invention is soft and flexible. Furthermore, the appearance and durability of the book of the present invention is significantly enhanced due to the use of the binding cord, and it is fully expected that various types of cords and colors of cords may be used which provide further enhancement to the book. Also, the use of the foam material is ideal for children's books, as it is safe and pliable and floats in water. Finally, because the binding cord and binding holes of the present invention may be made of any length, size or shape so long as the binding function is maintained, the restrictions on the size, thickness and shape of the book formerly dictated by the prior art binding methods are substantially eliminated. It is therefore seen that the present invention provides a substantial improvement over those devices found in the prior art.

DESCRIPTION OF THE PREFERRED EMBODIMENT

Figure 1:
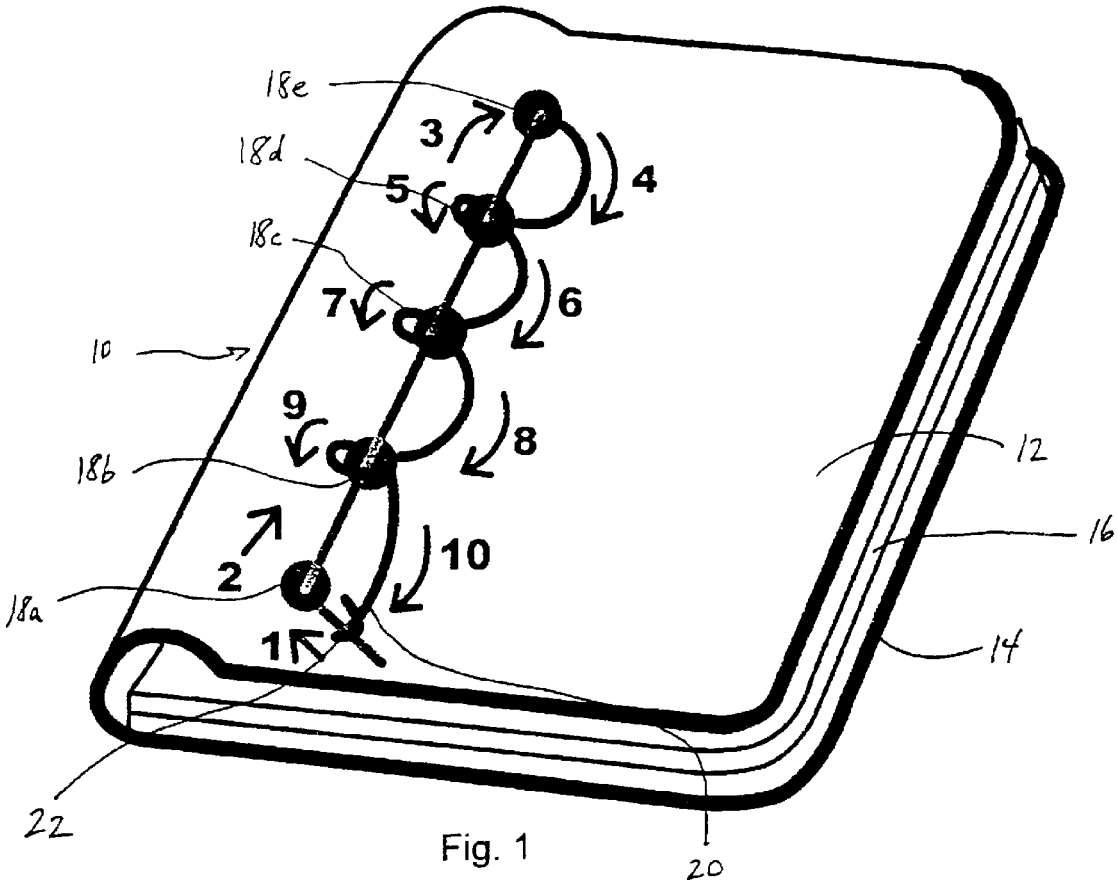
FIG. 1 is a perspective view of a first embodiment of the foam book with improved binding of the present invention.

The book with improved binding 10 of the present invention is shown best in FIGS. 1–6 as including a front cover page 12, a rear cover page 14 and plurality of center pages 16 which are aligned in traditional book format. In the preferred embodiment, each of the pages 12, 14 and 16 would be constructed of a foam material, specifically the foam marketed under the common name "Eva foam." "Eva foam" is a polymer foam made of ethyl-vinyl acetate and is particularly well-suited for the present application as it is safe, non-toxic and may be printed on quite easily. Furthermore, it is pliable and floats in water, thus making it a very suitable material for the construction of children's books. However, it should be noted that numerous other types of materials are suitable for use with the present invention so long as the safety and convenience feature of the present invention are maintained.

Figure 2:
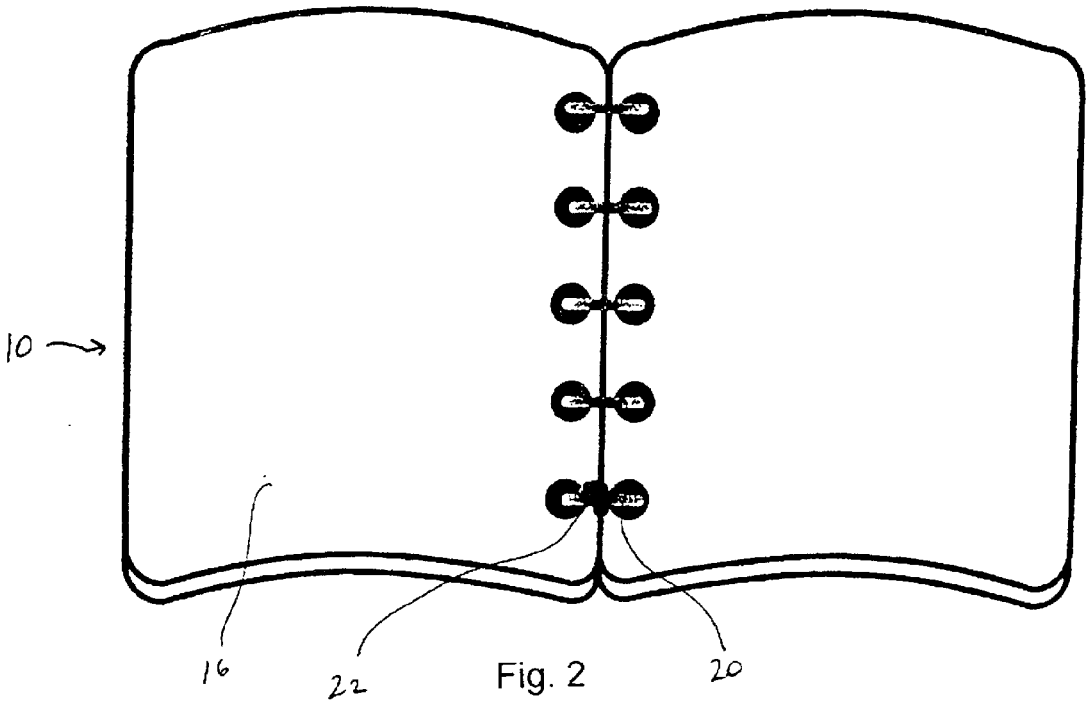
FIG. 2 is a top plan view of the embodiment of FIG. 1 showing the completed binding of the book.

Each of the front cover page 12, rear cover page 14 and center pages 16 would further include a plurality of binder holes 18*a*, 18*b*, 18*c*, 18*d* and 18*e*, as shown best in FIGS. 1 and 2, each of which extends completely through the page in which it is formed. In the preferred embodiment, the binder holes 18*a–e* may be formed along a line extending generally parallel with the left edge 19 of each page 12, 14 and 16, the binder holes 18*a–e* being spaced along the line with approximately the same distance between adjacent binder holes 18*a–e*. It should be noted that the exact size, shape and number of binder holes 18*a–e* is not critical to the present invention as long as the holes are of sufficient size to permit the insertion of the binder cord 20 and are positioned to retain each of the front, rear and center pages 12, 14 and 16 in the desired book format. Furthermore, when the pages 12, 14 and 16 are aligned with one another, the binder holes 18*a–e* are generally vertically aligned in binder hole groups such that the binder cord 20 can be passed through each binder hole group to secure the pages 12, 14 and 16 in the desired book format.

As was stated above, a binder cord 20 is used to securely bind the front, rear and center pages 12, 14 and 16 together in the book format. It is expected that the binder cord 20 would be constructed of any appropriate cord material, such as nylon, cotton, or other such fibers, so long as the binder cord 20 is safe in use, non-toxic, flexible and has a long use lifespan.

In the preferred embodiment, a nylon cord having a diameter of approximately one-sixteenth of an inch would be used. Also, it should it noted that as the construction material may be varied with the binder cord 20, the color of the cord maybe modified, along with other functional and ornamental aspects of the binder cord 20. Most importantly, however, it should be noted that are numerous ways the binder cord 20 maybe threaded through the binder holes 18*a–e* to securely bind the front, rear and center pages 12, 14 and 16 to one another in the book format as shown best in FIG. 1. Of the numerous methods of passing the binding cord 20 through the binder holes 18*a–e*, the present disclosure discusses three preferred binding methods, the three methods corresponding to the Figures as follows: Method One, FIGS. 1 and 2; Method Two, FIGS. 3 and 4; and Method Three, FIGS. 5 and 6. Each of these will be briefly described in order to fully communicate the inventive binding techniques of the present invention. It should also be noted that in each of FIGS. 1, 3 and 5, there are additional numbers which illustrate the steps of threading the binding cord 20 through the binding holes 18*a–e*, and these should not be confused with the reference numerals given herein. Rather, these numerical steps indicators have been included in the drawings to clarify the binding and threading steps used in the present invention, and are believed to accomplish their intended objective.

Method One, shown in FIGS. 1 and 2, involves the following steps. The binder cord 20 is passed upwards through binder hole 18*a* from rear cover page 14 up through front cover page 12, with a sufficient length of binder cord 20 remaining below the book 10 to tie the final knot. The binder cord 20 is then moved over the top of front cover page 12 to binder hole 18*e* and is passed therethrough from front cover page 12 to rear cover page 14, the end of binder cord 20 then being looped underneath the book 10 to binder hole 18*d* and the end of binder cord 20 is extended upwards through. The binder cord 20 is then looped over the extended section of the binder cord 20 which is on top of front cover page 12, as labeled by step number 5, and the same procedure is done with binder holes 18*c* and 18*b*. Finally, the binder cord 20 is tied to itself adjacent binder hole 18*a* and the resulting knot 22 is positioned between the front and rear covers 12 and 14 as shown best in FIG. 2. A dab of glue or the like may be added to the knot 22 to secure the binder cord 20, thus resulting in a securely bound book 10.

Figure 3:
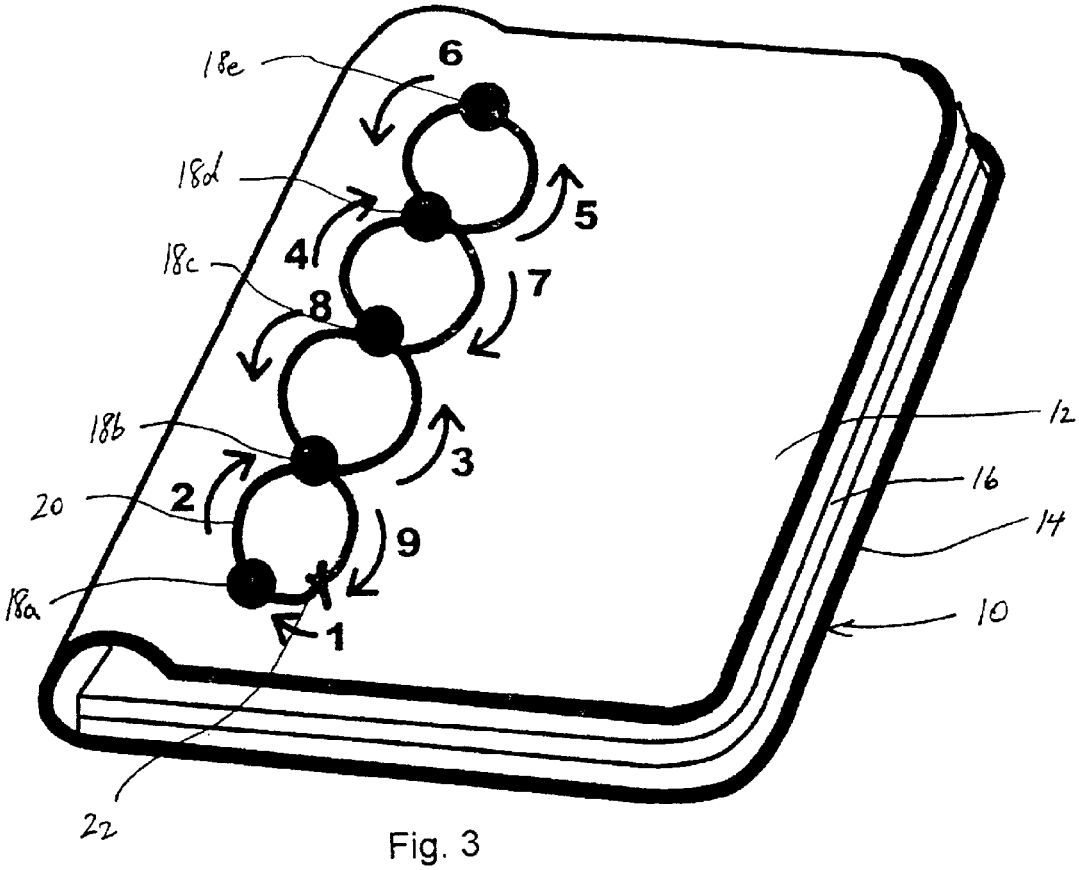
FIG. 3 is a perspective view of a second embodiment of the foam book with improved binding of the present invention.
Figure 4:
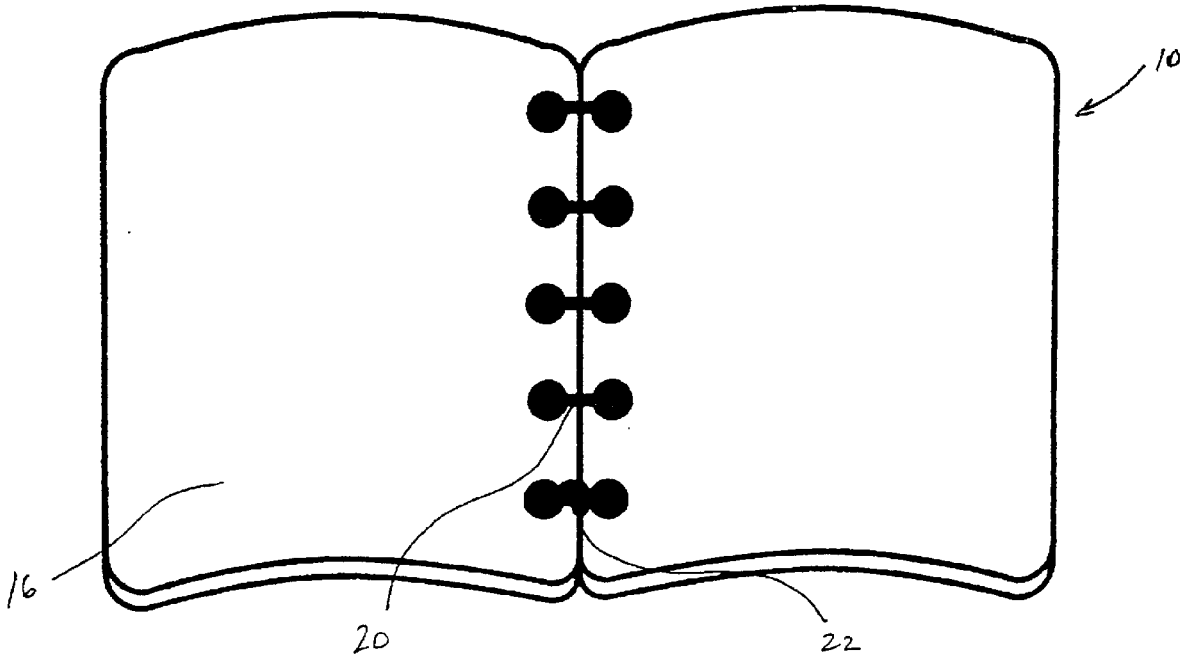
FIG. 4 is a top plan view of the embodiment of FIG. 3 showing the completed binding of the book.

Method Two, shown in FIGS. 3 and 4, illustrates a second alternative method of binding the front, rear and center pages 12, 14 and 16 with binder cord 20. Again, beginning adjacent rear cover page 14, the binder cord 20 is passed upwards through binder hole 18*a* and through front cover page 12 and back down into front cover page 12 through binder hole 18*b*. As the end of binder cord 20 exits binder hole 18*b* through rear cover page 14 it is then passed upwards through binder hole 18*c* and this looping and threading is continued until the binder cord 20 passes upwards through binder hole 18*e*.

The binder cord 20 is then looped back through each of the binder holes 18*a–d* in turn until the end of binder cord 20 is again adjacent to binder hole 18*a*. Once again the ends are tied to one another in a knot 22 and a dab of glue or the like may be applied thereto with the knot 22 being positioned within the book 10 as shown best in FIG. 4. Again, an elegant and simple solution to the binding problem found in the prior art.

Figure 5:
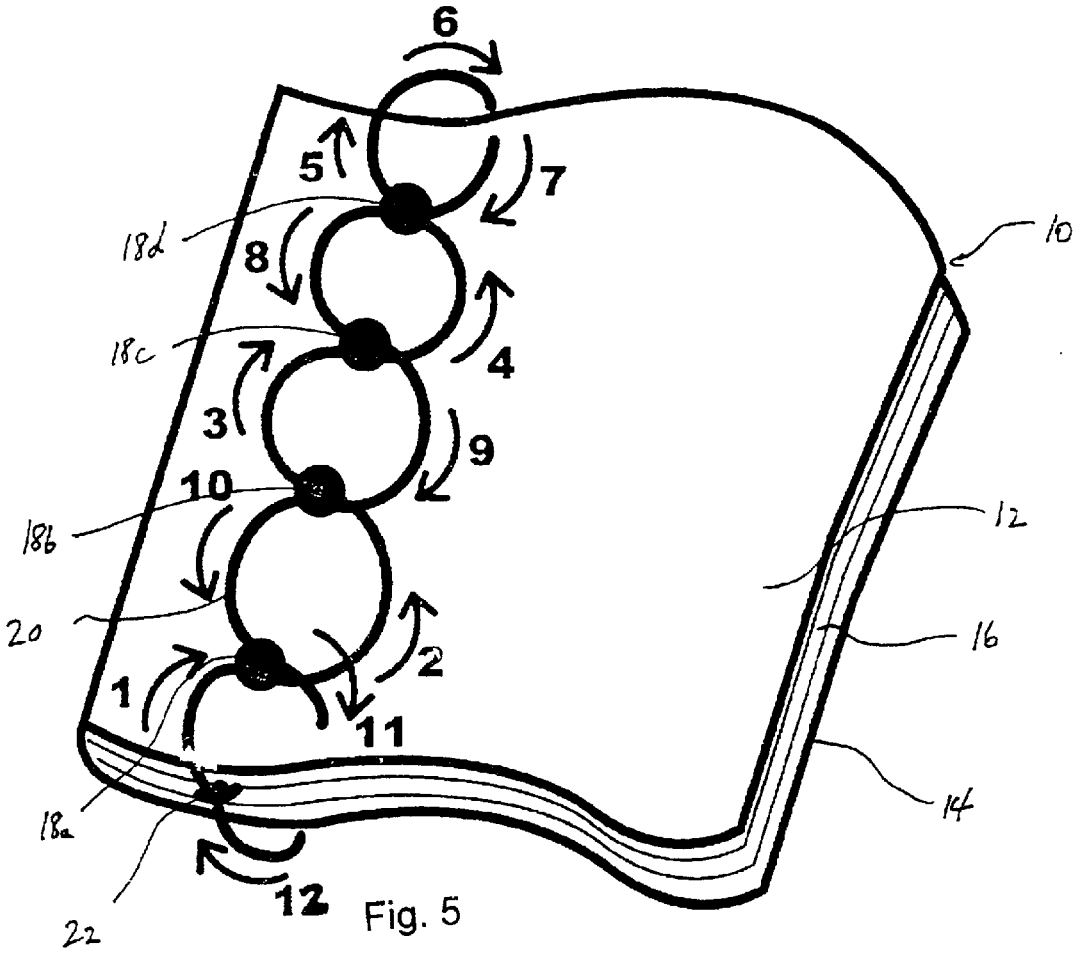
FIG. 5 is a perspective view of a third embodiment of the foam book with improved binding of the present invention.
Figure 6:
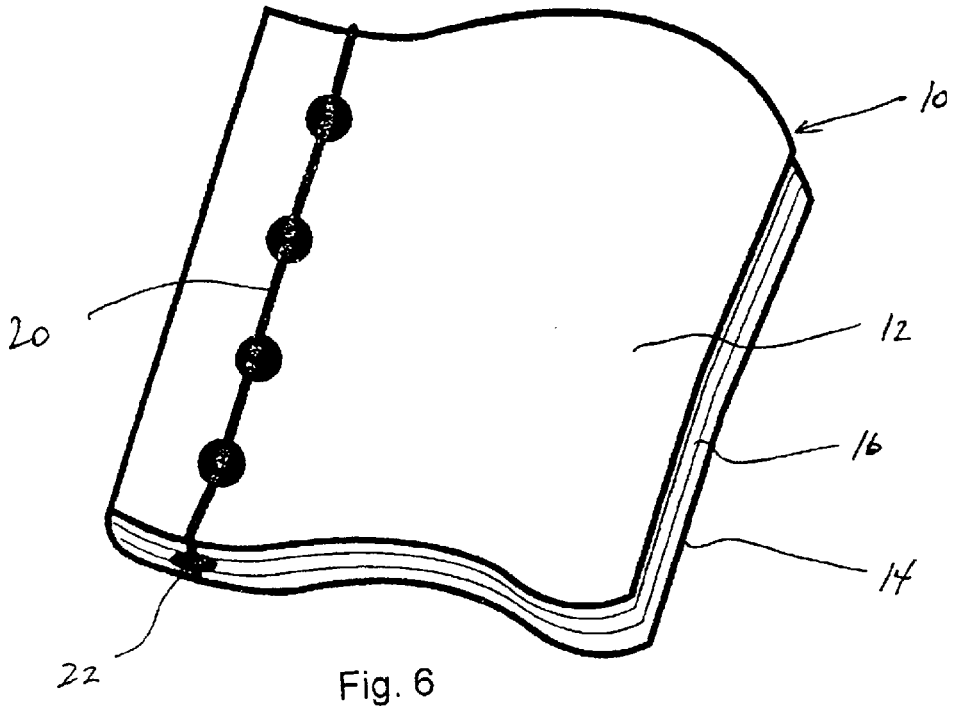
FIG. 6 is a perspective view of the embodiment of FIG. 5 showing the completed binding of the book.

Binding Method Three, shown best in FIGS. 5 and 6, leaves the knot 22 on the outside of the book 10 and utilizes substantially the same steps as described in connection with Method Two shown in FIGS. 3 and 4. However, Method Three includes two added loops of binder cord 20 extending around the upper and lower edges of the book 10 adjacent to binder holes 18*a* and 18*e*, as shown best in FIG. 5 to provide additional securement and enhance the appearance of the book 10. Once again, the two ends of the binder cords 20 are tied to one another to form a knot 22 which is secured in the manner described previously in connection with Methods One and Two. Of course, it should be noted that numerous other types of binder cord threading techniques may be used with the present invention so long as the intended function of utilizing a binder cord 20 to secure the front, rear and center pages 12, 14 and 16 to one another in a book format is achieved.

It is to be understood that the book with improved binding 10 of the present invention may include numerous additions, modifications and substitutions which will fall within the intended broad scope of the appended claims. For example, although the present invention has been described as being used in connection with front, rear and center pages 12, 14 and 16, it should be noted that it is common in the book production field to fold pages over to form two pages joined by a crease, particularly with children's books in connection with the front and rear cover pages 12 and 14. These are often formed from a single longer piece of foam which is folded over to form the front and rear cover pages 12 and 14. Furthermore, the specific materials used in connection with the present invention may be modified or changed so long as the intended functional and use aspects of the invention are maintained. This would include substitution of various types of foam for the pages of the book, substitution of various types of binder cord which maybe used to enhance the functionality and the appearance of the invention and the use of any appropriate non-toxic waterproof adhesive or binding compound for the securement of the knot in the methods of construction. Furthermore, it may be beneficial to bind the book in such a manner that the book may be unbound and rearranged to reorder the pages in the book, a feature easily done with the present invention but which is not available with the binding methods and apparatuses of the prior art. Finally, it should be noted the precise size, shape and number of the binder holes 18*a–e* is not critical to the present invention, so long as the binder cord 20 may be passed therethrough to bind the pages together. In this manner, pages of various sizes and shapes may be bound to one another by utilizing the apparatus and methods of the present invention.

There has therefore been shown and described a book with improved binding which accomplishes at least all of its intended objectives.

I claim:

1. A method of binding a book comprising the steps:

providing a front cover page having at least four binding holes extending therethrough, a rear cover page having at least four binding holes extending therethrough, at least one center page having at least four binding holes extending therethrough and positioned between said front cover page and said rear cover page and a binder cord;

aligning each of said at least four binding holes of said front cover page, said rear cover page and said at least one center page such that each of said at least four binding holes are generally vertically aligned with vertically adjacent binding holes in adjacent pages;

passing a looped section of said binder cord upwards through at least a selected two of said at least four binding holes in said rear cover page through the vertically adjacent one of said at least four binding holes in said at least one middle page and through the vertically adjacent one of said at least four binding holes in said front cover page;

passing said binder cord through each of said looped sections of said binder cord above said front cover page; and securing said binder cord to itself to secure said binder cord within said at least one binding holes thereby securing said front cover page, said rear cover page and said at least one center pages in a bound book format.

2. The method of claim 1 wherein said alignment step further comprises aligning said at least one binding holes of said front cover page, said rear cover page and said at least one center page generally vertically in at least one generally vertical binder hole group such that said binder cord is passed therethrough to releasably secure said front cover page, said rear cover page and said at least one center page in book format.

* * * * *